US008202065B2

(12) United States Patent
Siegel et al.

(10) Patent No.: US 8,202,065 B2
(45) Date of Patent: Jun. 19, 2012

(54) HIGH PRESSURE FUEL PUMP

(75) Inventors: Heinz Siegel, Stuttgart (DE); Volkmar Goldschmitt, Asperg (DE); Martin Laich, Murr (DE); Peter Ropertz, Oberriexingen (DE); Siamend Flo, Stuttgart (DE); Klaus Lang, Stuttgart (DE); Joachim Zumbraegel, Eberdingen (DE); Rainer Wilms, Markgroeningen (DE); Berthold Pfuhl, Markgroeningen (DE); Victorio Toscano, Rodermark (DE); Hans-Werner Schlingensief, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 835 days.

(21) Appl. No.: 12/298,407

(22) PCT Filed: Apr. 16, 2007

(86) PCT No.: PCT/EP2007/053682

§ 371 (c)(1),
(2), (4) Date: Oct. 24, 2008

(87) PCT Pub. No.: WO2007/122127

PCT Pub. Date: Nov. 1, 2007

(65) Prior Publication Data

US 2009/0252621 A1 Oct. 8, 2009

(30) Foreign Application Priority Data

Apr. 25, 2006 (DE) ..... 10 2006 019 049
Mar. 29, 2007 (DE) ..... 10 2007 016 134

(51) Int. Cl.
*F04B 49/00* (2006.01)

(52) U.S. Cl. ..... 417/307; 417/440

(58) Field of Classification Search ..... 417/307, 417/440

See application file for complete search history.

(56) References Cited

U.S. PATENT DOCUMENTS

| | | | | |
|---|---|---|---|---|
| 3,269,406 | A * | 8/1966 | Grose | 137/436 |
| 4,675,003 | A * | 6/1987 | Hooven | 604/9 |
| 2003/0116122 | A1 | 6/2003 | Haeberer et al. | |
| 2005/0076955 | A1 * | 4/2005 | Boehland et al. | 137/539.5 |
| 2005/0205065 | A1 | 9/2005 | Rembold et al. | |

FOREIGN PATENT DOCUMENTS

| | | | |
|---|---|---|---|
| DE | 4317751 | A1 | 12/1993 |
| DE | 4426667 | A1 | 2/1996 |
| DE | 4430472 | A1 | 2/1996 |
| DE | 19548167 | A1 | 6/1997 |
| DE | 19927197 | A1 | 12/2000 |
| DE | 102004013307 | A1 | 9/2005 |
| EP | 0268520 | A2 | 5/1988 |
| EP | 0935719 | B1 | 12/2004 |
| GB | 2058948 | A | 4/1981 |
| WO | 0244549 | A2 | 6/2002 |
| WO | 2005054663 | A1 | 6/2005 |

* cited by examiner

*Primary Examiner* — Mariceli Santiago
*Assistant Examiner* — Glenn Zimmerman
(74) *Attorney, Agent, or Firm* — Ronald Greigg

(57) ABSTRACT

A high pressure fuel pump encompasses at least one delivery chamber and one high pressure outlet. in addition, a pressure limiting valve with a valve that is actuated by a pressure differential is provided that can open from the high pressure outlet to the delivery chamber. On a high pressure side of a valve seat of the pressure limiting valve, it is advantageous that a throttle device is provided, whose free cross section is at most approximately equal to a desired maximum opening cross section of the pressure limiting valve.

24 Claims, 6 Drawing Sheets

HIGH PRESSURE FUEL PUMP

CROSS-REFERENCE TO RELATED APPLICATION

This application is a 35 USC 371 application of PCT/EP 2007/053682 filed on Apr. 16, 2007.

BACKGROUND OF THE INVENTION

1. Field of the Invention

The invention relates to a high pressure fuel pump with a pressure relief valve.

2. Description of the Prior Art

A high pressure fuel pump of the type mentioned at the beginning is known from DE 10 2004 013 307 A1. In this one-cylinder piston pump, the delivery chamber can be connected to a high pressure outlet by means of a spring-loaded outlet valve. Fluidically parallel to the outlet valve, a pressure relief valve is provided, which has a spring-loaded valve ball as a valve element. The pressure relief valve opens toward the delivery chamber and, when open, connects the high pressure outlet to the delivery chamber. A pressure relief valve situated in such a way has the advantage that it protects the high pressure region from impermissibly high pressures, but simultaneously does not reduce the volumetric efficiency of the high pressure fuel pump since the pressure relief valve only opens when the pressure prevailing in the delivery chamber is significantly lower than the pressure in the high pressure outlet.

OBJECT AND SUMMARY OF THE INVENTION

The object of the present invention is to create a high pressure fuel pump of the type mentioned at the beginning that functions in a particularly reliable fashion.

According to the invention, the realization was reached that when the pressure relief valve opens, there is a danger of dynamic pressure impacts causing the valve element to lift away from the valve seat so far that it is pushed out of the valve seat and becomes jammed between the valve seat body and the spring plate. As a result, the pressure relief valve would no longer be able to close, thus rendering it impossible for pump delivery to occur. The measures taken according to the invention prevent this entire scenario: the throttle device limits the maximum volumetric flow coming out of the pressure relief valve so that the valve element of the pressure relief valve cannot exceed a maximum opening stroke. The throttle device functions more or less as a hydraulic stroke limitation.

This is achieved by special matching of the free cross section of the throttle device to the desired maximum opening cross section of the pressure relief valve, which corresponds to a stroke of the valve element at which the valve element is still assured of not becoming jammed. In most cases, it would be permissible for this maximum opening cross section to be an annular surface. The measure taken according to the invention prevents the valve element from coming out of the valve seat region when the maximum flow is passing through the pressure relief valve and assures that the valve element easily finds its way back to the valve seat again when the pressure relief valve closes. The throttle device also reduces the dynamic behavior of the pressure relief valve, which has a positive effect on the wear. Pressure peaks are only transmitted to the valve element in a damped fashion.

If the throttle device includes a part that is situated on the high pressure side in relation to the pressure relief valve, is separate from the pressure relief valve, and is equipped with a flow throttle, then it is possible for the previously used pressure relief valves to remain unchanged. This reduces the manufacturing costs.

The same aim is shared by the modification in which the separate part is secured in a press-fitted fashion in an overflow conduit of a pump housing.

The separate part can be embodied as cup-shaped and having a bottom section, with the flow throttle embodied in the farm of at least one opening in the bottom section. A part of this kind can be inexpensively manufactured as a formed and stamped sheet metal part.

With a throttle device that is situated on the high pressure side in relation to the pressure relief valve, it is advantageous if its free cross sectional area is at least approximately 0.6 to 1.1 times the cross sectional area of a valve seat of the pressure relief valve.

Alternatively or in addition to a flow throttle that is separate from the pressure relief valve, the throttle device can also include a flow throttle that is situated in a valve seat body of the pressure relief valve near or immediately adjacent to the valve seat and on the high pressure side in relation to it. This eliminates the handling of the separate part, which simplifies the assembly of the high pressure fuel pump according to the invention.

The flow throttle can be simply embodied in the form of a constriction in an inlet conduit in the valve seat body.

In a throttle device of this kind, the free cross sectional area of the flow throttle should be at least approximately 0.5 to 0.75 times the cross sectional area of the valve seat of the pressure relief valve. Such a design assures a good function of the pressure relief valve reliably prevents the valve element from jamming.

It is possible for the valve element of the pressure relief valve to be a spring-loaded ball that can be loosely installed, which is very inexpensive. The valve seat for such a ball is advantageously conical, with a cone angle of between approximately 30° and 50°. The more acute the angle, the better the seal when the pressure relief valve is closed.

It is also preferable for a free cross sectional area of an influx conduit directly upstream (i.e. to the high pressure side) of the valve seat (the term upstream here refers to the flow direction through the pressure relief valve) to be at least approximately 0.8 to 0.95 times the cross sectional area of the valve seat of the pressure relief valve. Such a narrow valve seat is advantageous for assuring that the pressure relief valve has a favorably low sensitivity to dirt. Such a narrow valve seat also permits a particularly favorable molding to the seat itself during operation.

In a particularly advantageous embodiment of the high pressure fuel pump according to the invention, a valve seat body of the pressure relief valve includes a securing section for the valve element that extends in the opening direction of the valve element and is embodied as an essentially annular collar. This securing section secures the valve element in a lateral direction when it is in the open position, i.e. lifted away from the valve seat, so that even with the occurrence of dynamic pressure impacts and a large opening stroke, it is impossible for the valve element to become jammed between the valve seat body and a valve spring that acts on the valve element. Finally, this measure according to the invention improves the operational reliability of the high pressure fuel pump since it prevents the pressure relief valve from jamming in the open position, thus preventing a buildup of high pressure in the high pressure fuel pump. Finally, the securing section assures that the valve element reliably finds its way back to the valve seat again, even when executing a large stroke.

In a modification of this, the securing section is formed onto a valve seat region of the pressure relief valve in the vicinity of its valve seat. This reduces the number of parts to be handled during assembly, thus simplifying the assembly. In addition, the manufacturing costs for the securing section are reduced since it is necessary for the valve seat region of the pressure relief valve to be machined anyway.

It is particularly advantageous if at least one flow conduit, in particular a flow pocket, preferably extending essentially the length of the securing section, is embodied on the radial inside of the securing section. When the pressure relief valve is open, a flow conduit of this kind—which is introduced, for example, by means of a recess permits a low-resistance flow between the valve element and the inside of the securing section with a simultaneously close guidance of the valve element through the securing section. The fluid can easily flow through the flow conduit between the inside of the securing section and the open valve element and can flow past a valve element holder possibly provided to hold the valve element.

The same aim is shared by the embodiment of the high pressure fuel pump according to the invention in which the securing section has at least one slot preferably extending essentially over its length. Such a slot is particularly inexpensive to manufacture.

Also according to the invention, the radial inside of the securing section includes a conical surface that widens out in the opening direction of the pressure relief valve. When the pressure relief valve is open, this creates the open space that permits a low-resistance flow of the fluid between the securing section on the one hand and the valve element and valve element holder on the other. In this context, the cone angle of the conical surface can at least approximately correspond to the cone angle of the valve seat, which permits a relatively simple manufacture. The cone angle of the conical surface can, however, also be greater than the cone angle of the valve seat, which, with a small opening stroke of the valve element, results in a comparatively large free space between the radial inside of the securing section on the one hand and the valve element and valve element holder on the other.

It is also particularly advantageous if the valve seat body has a shoulder that is adjacent to the valve seat and extends at least approximately in the radial direction, from which the radial inside of the securing section extends in the opening direction of the pressure relief valve. This measure can be used in combination both with the above-mentioned flow pockets or flow slots and with the above-mentioned conical surface. The presence of the shoulder avoids the exertion of closing flow forces on the valve element in its open position.

The pressure relief valve can include a piston-like valve element holder that acts on the valve element in the closing direction and protrudes into the securing section both when the pressure relief valve is closed and when it is open. This assures a particularly reliable guidance of the valve element.

BRIEF DESCRIPTION OF THE DRAWINGS

Particularly preferred exemplary embodiments of the present invention will be explained in greater detail with reference to the accompanying drawings, in which.

DESCRIPTION OF THE PREFERRED EMBODIMENTS

Figure 1:
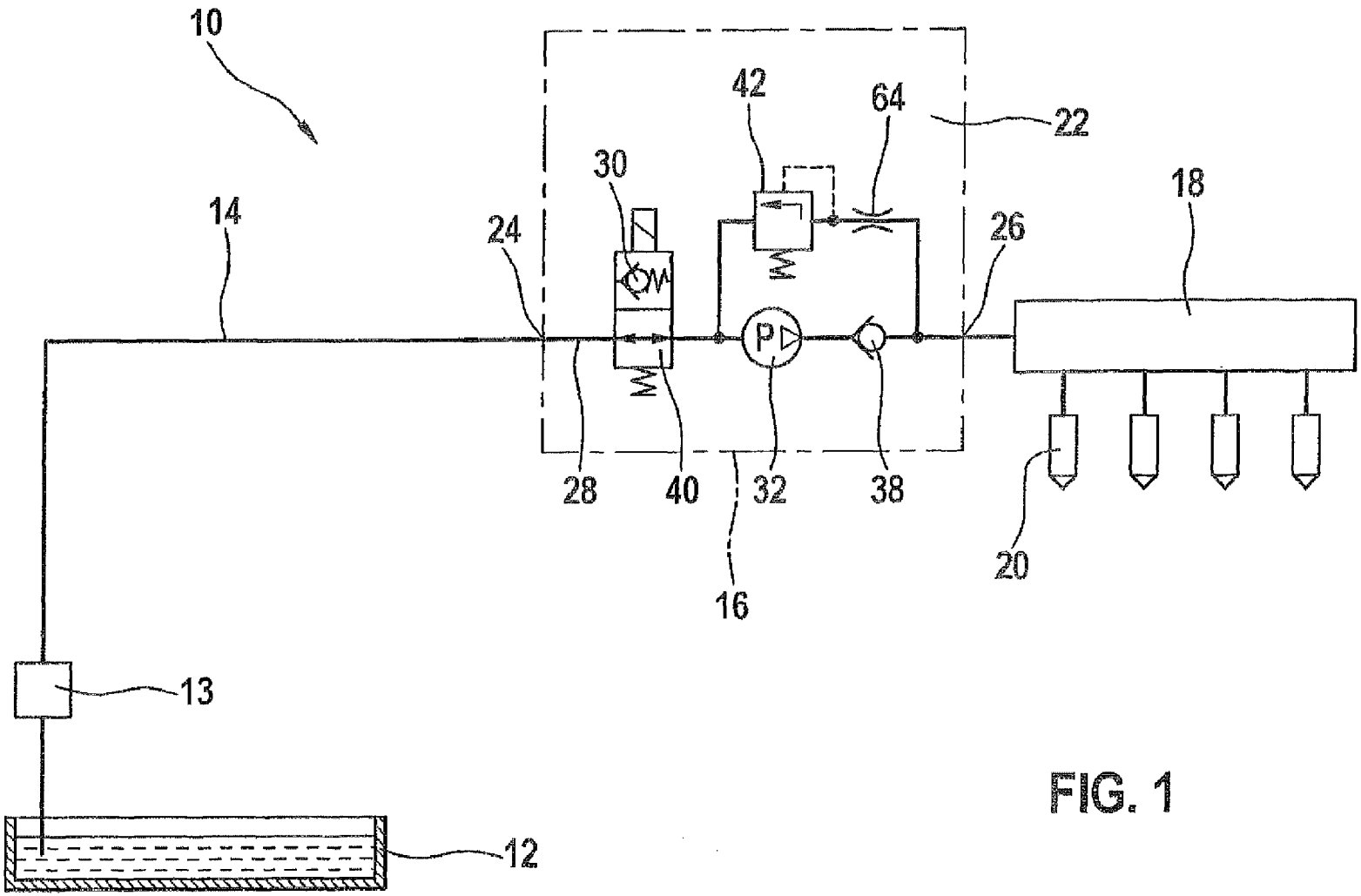
FIG. 1 is a schematic depiction of a fuel system equipped with a high pressure fuel pump.

In FIG. 1, a fuel system is labeled as a whole with the reference numeral 10. The fuel system 10, which is depicted only in simplified fashion in FIG. 1 includes a fuel receptacle 12 from which a presupply pump 13 delivers fuel into a low pressure fuel line 14. This line leads to a high pressure fuel pump 16 that compresses the fuel further and delivers it to a fuel accumulator 18 in which the fuel is stored at high pressure and which is also referred to as a "rail." The rail 18 is connected to a plurality of injectors 20 that inject the fuel directly into associated combustion chambers (not shown) of an internal combustion engine to which the fuel system 10 belongs.

Figure 2:
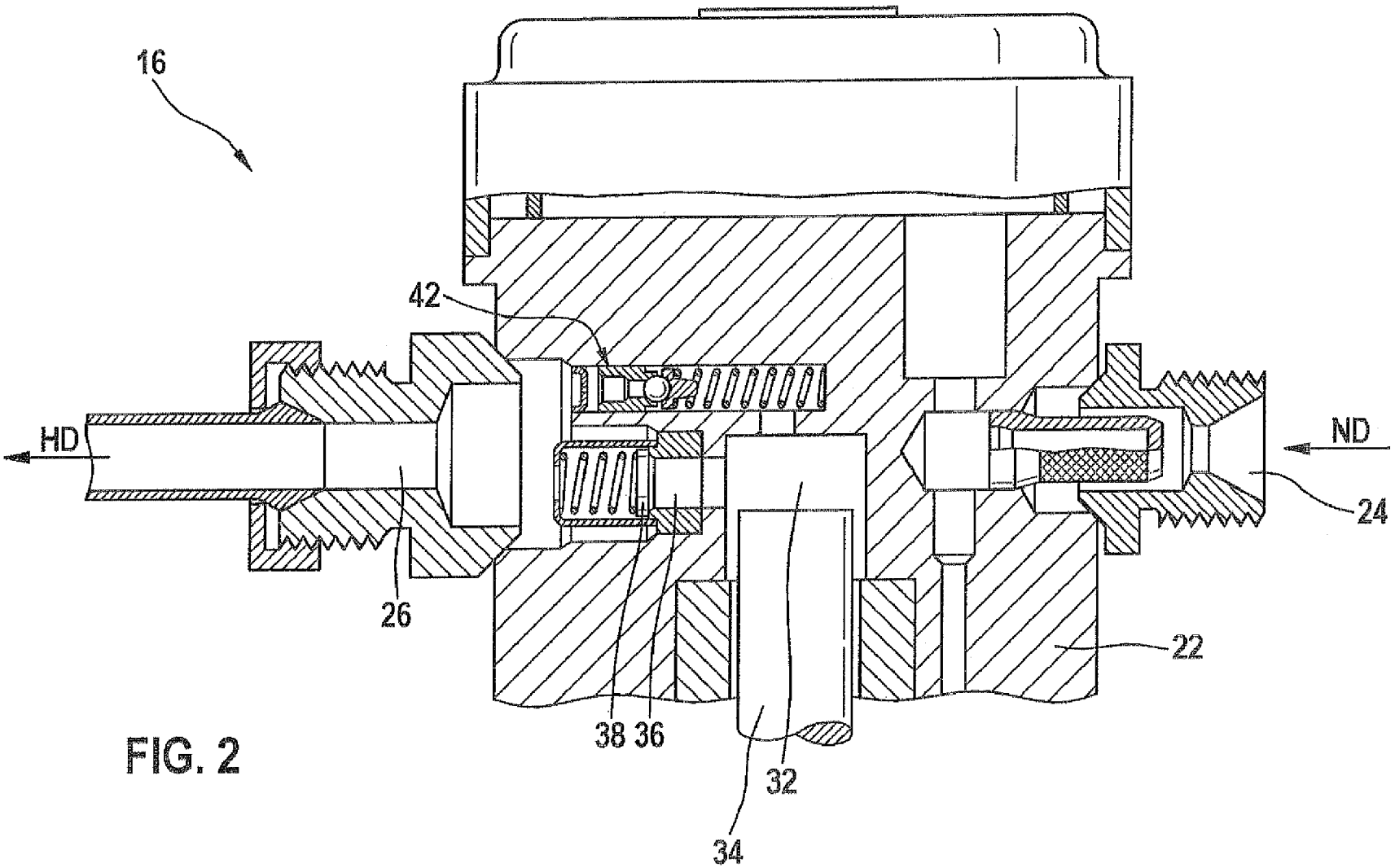
FIG. 2 is a partial section through the high pressure fuel pump from FIG. 1, with a first embodiment of a pressure relief valve and a throttle device.

It is clear from FIG. 2, the high pressure fuel pump 16 has a housing 22 with a low pressure inlet 24 and a high pressure outlet 26. The low pressure inlet 24 has an inlet conduit 28 leading from it to an inlet valve 30 (not visible in FIG. 2) and onward to a delivery chamber 32 that is delimited by a pump piston 34. An outlet conduit 36 leads via an outlet valve 38 to the high pressure outlet 26. The inlet valve 30 is integrated into a quantity control valve 40 that is able to forcibly connect the delivery chamber 32 to the region of the inlet conduit 28 situated upstream of inlet valve 30. In this way, it is possible to convey fuel back to the low pressure inlet 24 during a delivery stroke and thus to adjust the delivery quantity of the high pressure fuel pump 16.

A pressure relief valve 42 is situated fluidically parallel to the outlet valve 38. This pressure relief valve is depicted in greater detail in FIG. 3: it includes a valve seat body 44, which is situated in an overflow conduit 46 leading from the high pressure outlet 26 to the delivery chamber 32 and has a press-fitted fastening region 48. Toward the delivery chamber 32, the outer diameter of the valve seat body 44 tapers to form a valve seat region 50. The outer contour of the valve seat body 44 in this region can also be described as resembling a bottleneck. This prevents this valve seat region 50 from being deformed as the valve seat body 44 is being press-fitted into the overflow conduit 46.

The valve seat body 44 has an inlet conduit 52 passing through it in the longitudinal direction, which is embodied in the form of a stepped bore whose inner diameter in the valve seat region 50 is smaller than in the fastening region 48. The actual valve seat 54 for a valve element 56 embodied in the form of a valve ball is machined into the end of the inlet conduit 52 to the right in FIGS. 3 and 4. The valve seat 54 is conically embodied, with a cone angle of approximately 30° in the present instance. The half cone angle is indicated in FIG. 4 by an arrow labeled with the reference numeral 58. In principle, the cone angle should be between approximately 30° and 50°, a smaller cone angle having advantages with regard to the seal. The contact point of the valve element 56 with the valve seat 54 is linear, with a diameter $d_1$. The diameter $d_2$ of the inlet conduit 52 is smaller than the diameter $d_1$. In this way, a free cross sectional area $F_{d2}$ of the inlet conduit 52, which is situated toward the high pressure connection 26 in relation to the valve seat 54 and therefore on the high pressure side of it and is also situated immediately adjacent to the valve element 56, is at least approximately 0.8 to 0.95 times the cross sectional area $F_{d1}$ that is defined by the valve seat diameter $d_1$ at the valve seat 54.

The valve element 56 is acted on in the direction toward the valve seat 54 by a valve element holder 60 that is in turn engaged by a valve spring 62. An insertion depth of the valve element 56 into the inlet conduit 52 of the valve seat body 44 is labeled T in FIG. 3.

Toward the high pressure outlet 26 in relation to the pressure relief valve 42 and its valve seat 54, i.e. on the high pressure side of the pressure relief valve 42, a throttle device 64 is press-fitted into the overflow conduit 46. In the embodiment shown in FIGS. 2 through 4, this throttle device 64 is embodied as a cup-shaped part 65 that is separate from the pressure relief valve 42; it has a bottom region 66 and a circumferential wall region 68 extending approximately perpendicular to this bottom region. For example, the part 65 can be manufactured as a formed and stamped sheet metal part. In the bottom section 66, an opening is provided 70, which has a diameter $D_1$ and constitutes a flow throttle. In the present exemplary embodiment, the free cross sectional area $F_{D1}$ on the basis of the diameter D1 of the flow throttle 70 is 0.6 times the cross sectional area $F_{d1}$ on the basis of the diameter $d_1$ of the valve seat 54 of the pressure relief valve 42. In principle, however, values of between 0.6 and 1.1 times the latter are also conceivable.

The high pressure fuel pump 16 functions as follows: during an intake stroke of the pump piston 34, the inlet valve 30 opens and fuel flows out of the low pressure fuel line 14 into the delivery chamber 32. During a subsequent delivery stroke, the fuel enclosed in the delivery chamber 32 is compressed until finally, the outlet valve 38 opens and the fuel is pressed into the rail 18 at high pressure. if an excessively high pressure is built up in the rail 18 and therefore also in the region of the high pressure outlet 26, then the valve element 56, due to the pressure difference then prevailing, lifts away from the valve seat 54 during an intake stroke of the pump piston 34 and in opposition to the force of the valve spring 62. In this way, filet can flow out of the rail 18 and the high pressure outlet 26, through the overflow conduit 46 and the pressure relief valve 42, and into the delivery chamber 32. This relieves the pressure in the rail 18 and the high pressure outlet 26.

Figure 5:
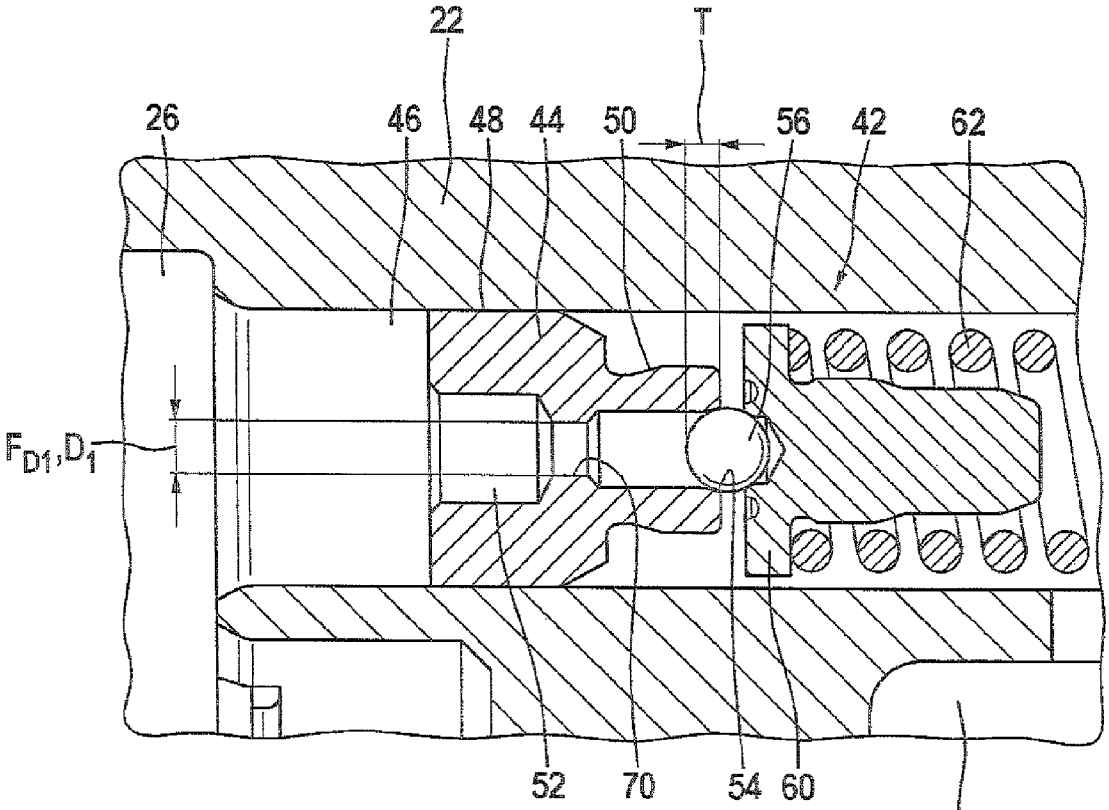
FIG. 5 is a depiction similar to FIG. 3 of a second embodiment.
Figure 6:
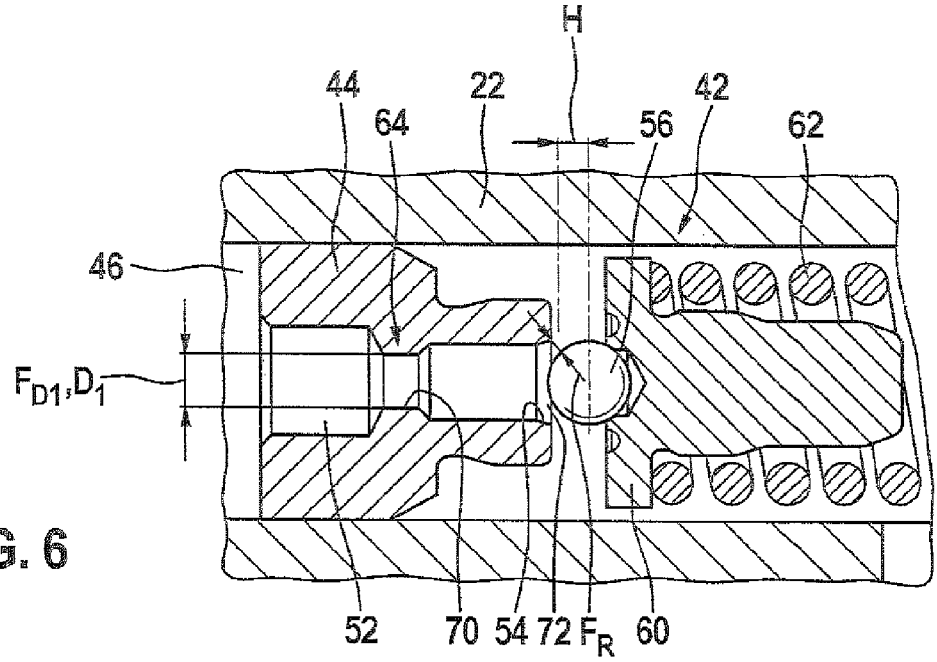
FIG. 6 is a depiction similar to FIG. 5 with the pressure relief valve open.

FIGS. 5 and 6 show an alternative embodiment. In this case and in the embodiments that follow, elements and regions that have functions equivalent to those of elements and regions described above are provided with the same reference numerals and are not explained again in detail.

In the embodiment of a high pressure fuel pump 16 shown in FIGS. 5 and 6, the throttle device 64 is not embodied as a separate part, but is instead integrated into the valve seat body 44 of the pressure relief valve 42, in the form of a constriction 70 situated on the high pressure side of and very near or immediately adjacent to the valve seat 54. In this instance, its free cross sectional area $F_{D1}$ in relation to its diameter $D_1$, is approximately 0.5 times the cross sectional area $F_{d1}$ of the valve seat 54 of the pressure relief valve 42 in relation to the diameter $d_1$.

Figure 3:
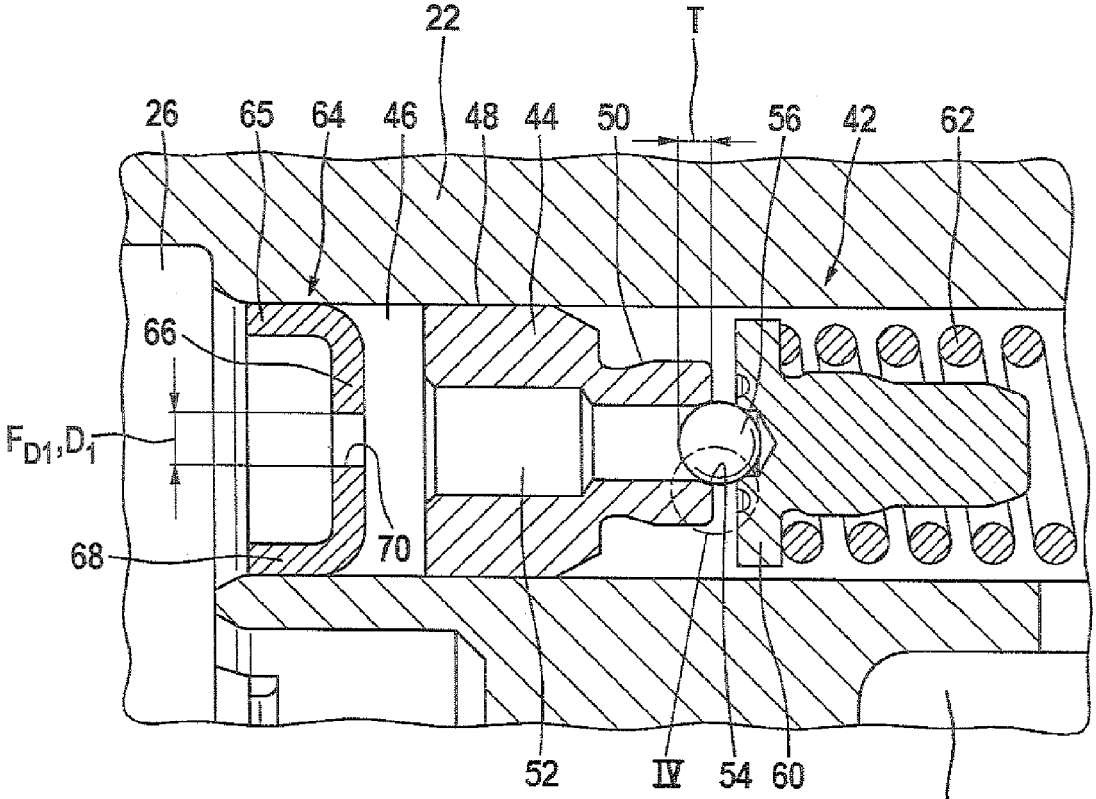
FIG. 3 is an enlarged detailed depiction of a region of the high pressure fuel pump from FIG. 2.
Figure 4:
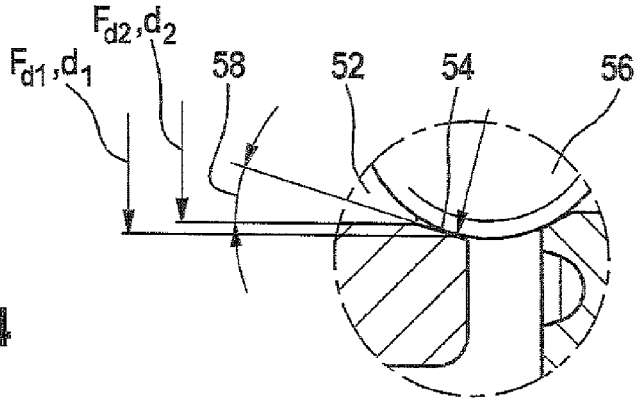
FIG. 4 shows a detail IV from FIG. 3.

In both the embodiment according to FIGS. 2 through 4 and the embodiment according to FIGS. 5 and 6, the free cross section of the flow throttle 70 is designed so that when the pressure relief valve 42 is open, i.e. when the valve element 56 has lifted away from the valve seat 54 (see FIG. 6), this free cross section of the flow throttle at most corresponds approximately to the annular opening cross section $F_R$ then produced by the gap 72 between the valve element 56 and the valve seat 54. This assures that the stroke H of the valve element 56 thus occurring is smaller than the insertion depth T, thus preventing the possibility of the valve element 56 becoming jammed between the valve seat body 44 and the valve element holder 60.

Figure 7:
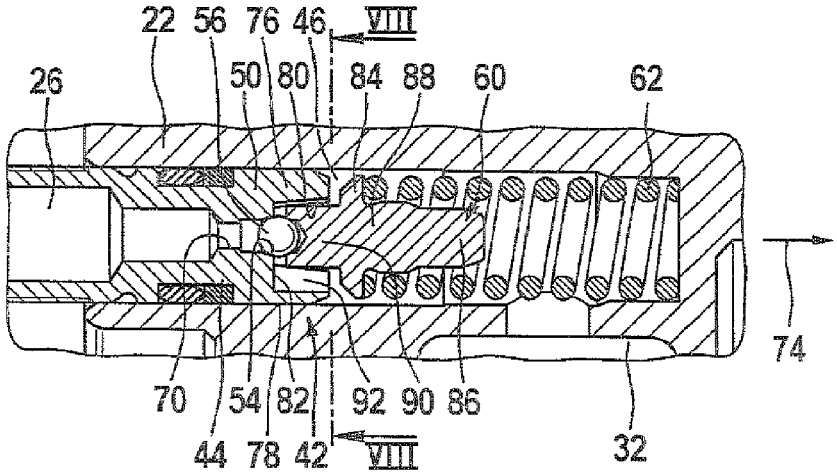
FIG. 7 is a depiction similar to FIG. 5 of a third embodiment.

FIG. 7 shows a region of another alternative embodiment of a high pressure fuel pump 16. With regard to the embodiment of the flow throttle 70, this pump corresponds to the one in the embodiment shown in FIGS. 5 and 6. In addition, however, the valve seat body 44 of the pressure relief valve 42 has an annular collar 76, which constitutes a securing section for the valve element 56, extending in the opening direction (arrow 74) of the valve element 56, i.e. in the axial direction of the pressure relief valve 42. The collar 76 here has a radial outside 78 with which it rests against the inside of the overflow conduit 46. A radial inside 80 of the collar 76 leads from a radially extending shoulder 82 to the protruding end of the collar 76. The shoulder 82 here extends in the radial direction starting approximately from the valve seat 54, i.e. is adjacent to the latter.

In the embodiment shown in FIG. 7, the valve element holder 60 is embodied as piston-like, with an annular flange 84 situated approximately in its axial middle, against which the valve spring 62 rests. In a fashion similar to the embodiments shown in FIGS. 3, 5 and 6, a peg-like section 86 of the valve element holder 60 leading from the annular flange 84 extends into the (unnumbered) annular chamber delimited by the valve spring 62. A region 88 of the peg-like section 86 situated close to the annular flange 84 has an outer diameter that is only negligibly smaller than the inner diameter of the valve spring 62. The valve element holder 60 is thus held against the valve spring 62 in a fashion that prevents tilting.

On the opposite side of the annular flange 84, a holding section 90 extends from the flange to the valve element 56. In the embodiment shown in FIG. 7, the holding section 90 has a cylindrical outer contour with a diameter that remains the same over its entire length. A blind hole (unnumbered) serves to radially secure the valve element 56 to the valve element holder 60. The outer diameter of the holding section 90 is selected so that the holding section 90 is still spaced slightly apart from the radial inside 80 of the collar 76 in the closed position of the pressure relief valve 42 depicted in FIG. 7. This prevents the holding section 90 from striking against the collar 76 before the valve element 56 has come to rest completely against the valve seat 54.

The length of the collar 76 and of the holding section 90 are, however, matched to each other so that both when the pressure relief valve 42 is closed and when it is open, the holding section 90 of the valve element holder 60 protrudes into the interior of the collar 76 delimited by the radial inside 80. In this way, the collar 76 assures that even in the event of dynamic pressure impacts and the resulting large opening strokes of the valve element 56, the valve element is not able to come out of the chamber delimited by the collar 76 and instead is able to reliably find its way back to the valve seat 54 again when the pressure relief valve 42 closes.

In order to assure as unhindered as possible an outflow of the fluid to the delivery chamber 32 when the valve element 56 has lifted away from the valve seat 54, three flow pockets 92 distributed around the circumference of the collar 76 are provided on the radial inside 80 of the collar 76. Starting from the shoulder 82, these pockets extend the entire length of the collar 76 to its protruding end and have a semicircular edge contour. This is particularly visible in FIG. 8.

Figure 8:
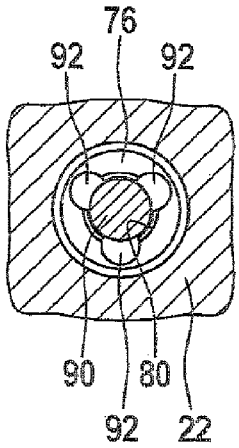
FIG. 8 is a section along the line VIII-VIII from FIG. 7.
Figure 10:
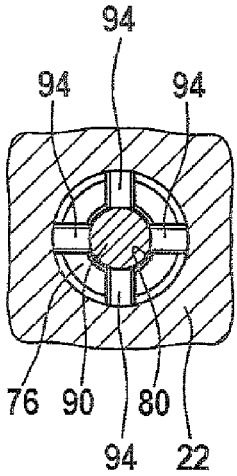
FIG. 10 is a section along the line X-X from FIG. 9.
Figure 9:
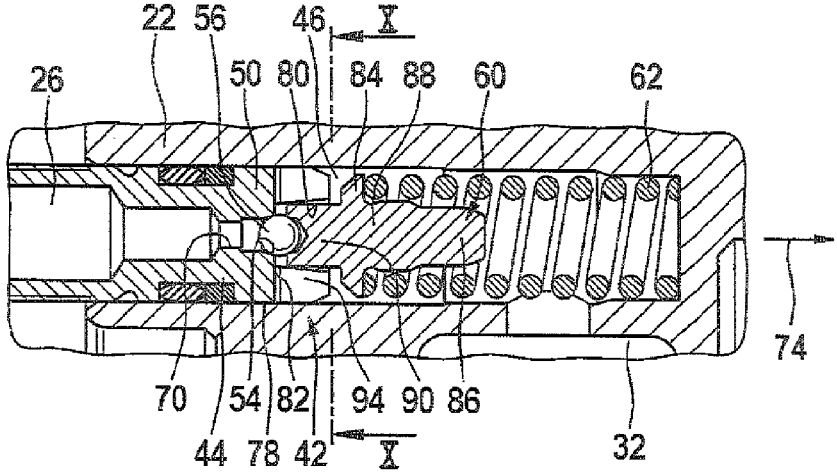
FIG. 9 is a depiction similar to FIG. 7 of a fourth embodiment.

An alternative embodiment shown in FIGS. 9 and 10 differs from the one in FIGS. 7 and 8 in that in lieu of the flow pockets in the collar/securing section 76, slots 94 are provided that extend over its entire thickness, likewise extending from the shoulder 82 over the entire length of the collar 76 to its protruding end.

Figure 11:
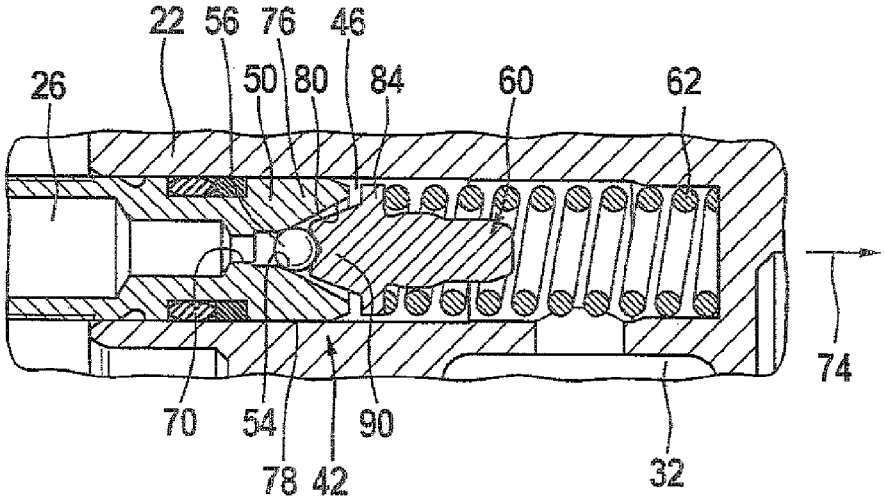
FIG. 11 is a depiction similar to FIG. 7 of a fifth embodiment.

FIG. 11 shows another variant: in this case, the radial inside 80 of the collar 76 is embodied in the form of a conical surface that widens out in the opening direction 74 of the pressure relief valve 42. The holding section 90 of the valve element holder 60 is embodied in a similarly conical fashion, but with a smaller cone angle than the radial inside 80 of the collar 76. An opening motion of the valve element 56 and the valve element holder 60 in the opening direction 74 produces an increasing distance between these elements on the one hand and the radial inside 80 of the collar 76 on the other, through which the fluid can flow out to the delivery chamber 32. The conical surface here can have approximately the same cone angle as the valve seat 54 (see FIG. 4 in particular) or a larger cone angle than the valve seat 54.

Figure 12:
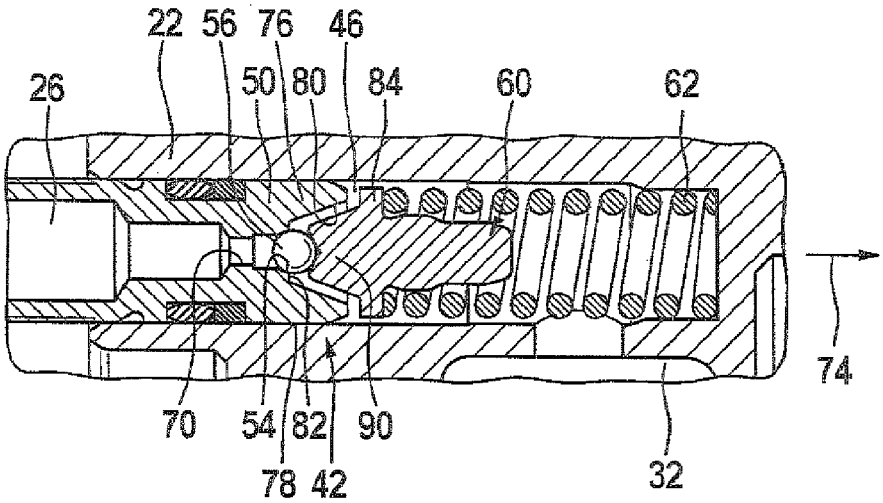
FIG. 12 is a depiction similar to FIG. 7 of a sixth embodiment.

In the embodiment shown in FIG. 11, the valve seat 54 transitions directly into the radial inside 80. hi the embodiment shown in FIG. 12, however, the valve seat 54 is first adjoined by a shoulder 82 that extends in the radial direction and the conical surface of the radial inside 80 of the collar 76 starts only after this shoulder. Here, too, the shoulder 82 eliminates or at least reduces a force acting on the valve element 56 in the closing direction when the valve element 56 is open.

Figure 13:
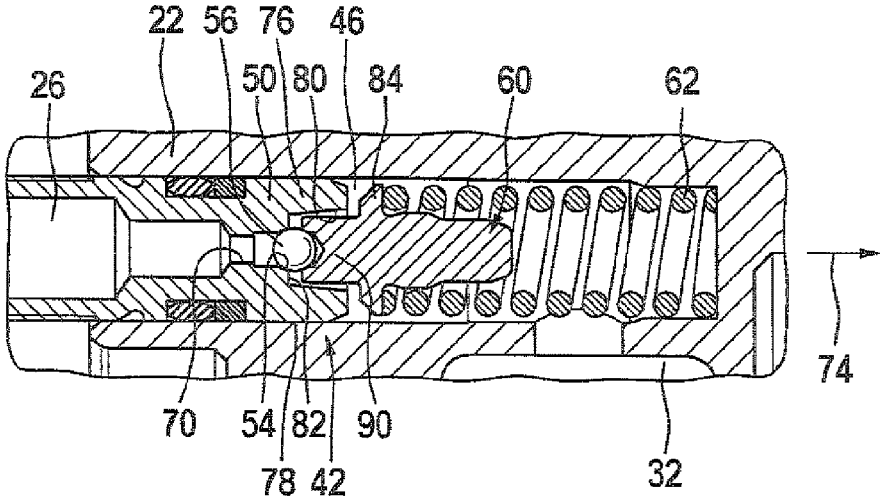
FIG. 13 is a depiction similar to FIG. 7 of a seventh embodiment.

An additional variant to FIG. 12 is shown in FIG. 13, in which the cone angle of the conical surface that constitutes the radial inside 80 of the collar 76 is relatively steep and the holding section 90 is embodied as cylindrical, with a uniform diameter. This variant has the advantage that when the pressure relief valve 42 is open, the outflow behavior is largely independent of the opening stroke of the valve element 56.

The foregoing relates to the preferred exemplary embodiments of the invention, it being understood that other variants and embodiments thereof are possible within the spirit and scope of the invention, the latter being defined by the appended claims.

The invention claimed is:

1. A common rail high pressure fuel pump, comprising:
an inlet valve;
at least one delivery chamber;
a high pressure outlet connectable with a common rail;
a pressure relief valve having a pressure differential-actuated valve element that opens from the high pressure outlet to the delivery chamber;
a valve seat disposed in the pressure relief valve; and
a throttle device provided on a high pressure side of the pressure relief valve relative to the valve seat thereof, wherein the throttle device has a free cross section that is at most approximately equal to a desired maximum opening cross section of the pressure relief valve, at which the valve element is still assured of not becoming jammed.

2. A high pressure pump, comprising:
at least one delivery chamber;
a high pressure outlet;
a pressure relief valve having a pressure differential-actuated valve element that opens from the high pressure outlet to the delivery chamber;
a valve seat disposed in the pressure relief valve; and
a throttle device provided on a high pressure side of the pressure relief valve relative to the valve seat thereof, wherein the throttle device has a free cross section that is at most approximately equal to a desired maximum opening cross section of the pressure relief valve, wherein the throttle device includes a part that is equipped with a flow throttle, and further is separate from the pressure relief valve and is situated on the high pressure side relative to the pressure relief valve.

3. The high pressure pump as recited in claim 2, wherein the separate part is press-fitted into an overflow conduit of a pump housing.

4. The high pressure pump as recited in claim 2, wherein the separate part is embodied as cup-shaped and having a bottom section, with the flow throttle embodied by at least one opening in the bottom section.

5. The high pressure pump as recited in claim 3, wherein the separate part is embodied as cup-shaped and having a bottom section, with the flow throttle embodied by at least one opening in the bottom section.

6. The high pressure pump as recited in claim 2, wherein the throttle device is embodied by the flow throttle having a free cross sectional area that is at least approximately 0.6 to 1.1 times a cross sectional area of a valve seat of the pressure relief valve.

7. The high pressure pump as recited in claim 3, wherein the throttle device is embodied by the flow throttle having a free cross sectional area that is at least approximately 0.6 to 1.1 times a cross sectional area of a valve seat of the pressure relief valve.

8. The high pressure pump as recited in claim 4, wherein the throttle device is embodied by the flow throttle having a free cross sectional area that is at least approximately 0.6 to 1.1 times a cross sectional area of a valve seat of the pressure relief valve.

9. The high pressure pump as recited in claim 1, wherein the throttle device includes a flow throttle that is situated in a valve seat body of the pressure relief valve near or immediately adjacent to the valve seat and on the high pressure side in relation thereto.

10. The high pressure pump as recited in claim 9, wherein the flow throttle is embodied by a constriction in an inlet conduit in the valve seat body.

11. The high pressure pump as recited in claim 6, wherein the throttle device is embodied by the flow throttle having a free cross sectional area that is at least approximately 0.5 to 0.75 times the cross sectional area of the valve seat of the pressure relief valve.

12. The high pressure pump as recited in claim 9, wherein the throttle device is embodied by the flow throttle having a free cross sectional area that is at least approximately 0.5 to 0.75 times the cross sectional area of the valve seat of the pressure relief valve.

13. The high pressure pump as recited in claim 1, wherein a valve element of the pressure relief valve includes a spring-loaded ball and the valve seat is conical, with a cone surface angle of between approximately 30° and 50° .

14. The high pressure pump as recited in claim 1, wherein a free cross sectional area of an inlet conduit immediately upstream of the valve seat is at least approximately 0.8 to 0.95 times a cross sectional area of the valve seat of the pressure relief valve.

15. A common rail high pressure fuel pump comprising:

An inlet valve;

at least one delivery chamber;

a high pressure outlet connectable with a common rail;

a pressure relief valve having a pressure differential-actuated valve element that opens from the high pressure outlet to the delivery chamber;

a valve seat disposed in the pressure relief valve; and a throttle device provided on a high pressure side of the pressure relief valve relative to the valve seat thereof, wherein the throttle device has a free cross section that is at most approximately equal to a desired maximum opening cross section of the pressure relief valve, wherein a valve seat body of the pressure relief valve includes a securing section for a valve element, which extends in an opening direction of the valve element and which is embodied as an essentially annular collar.

16. The high pressure pump as recited in claim 15, wherein the securing section is formed onto a valve seat region of the pressure relief valve in a vicinity of its valve seat.

17. The high pressure pump as recited in claim 15, wherein at least one flow conduit, in particular a flow pocket, is embodied on a radial inside of the securing section and which preferably extends essentially over the length of the securing section.

18. The high pressure pump as recited in claim 16, wherein at least one flow conduit, in particular a flow pocket, is embodied on a radial inside of the securing section and which preferably extends essentially over the length of the securing section.

19. The high pressure pump as recited in claim 15, wherein the securing section has at least one slot, preferably extending essentially over an entire length of the securing section.

20. The high pressure pump as recited in claim 15, wherein a radial inside of the securing section includes a conical surface that widens out in the opening direction of the pressure relief valve.

21. The high pressure pump as recited in claim 20, wherein a cone angle of the conical surface at least approximately corresponds to the cone angle of the valve seat.

22. The high pressure pump as recited in claim 20, wherein a cone angle of the conical surface is greater than the cone angle of the valve seat.

23. The high pressure pump as recited in claim 15, wherein adjacent to the valve seat, the valve seat body has a shoulder extending at least approximately in a radial direction, from which a radial inside of the securing section extends in the opening direction of the pressure relief valve.

24. The high pressure pump as recited in claim 15, wherein the pressure relief valve has a piston-like valve element holder that acts on the valve element in a closing direction and, both when the pressure relief valve is closed and when it is open, the holder protrudes into an interior delimited by the securing section.

* * * * *